United States Patent [19]

Fisch et al.

[11] 3,938,998

[45] Feb. 17, 1976

[54] LOW CONTRAST, RAPID ACCESS, AIR STABLE, REGENERABLE IRON CHELATE DEVELOPER SOLUTIONS

[75] Inventors: Richard S. Fisch; Norman Newman, both of St. Paul, Minn.

[73] Assignee: Minnesota Mining and Manufacturing Company, St. Paul, Minn.

[22] Filed: Mar. 28, 1975

[21] Appl. No.: 563,087

[52] U.S. Cl. ..... 96/66.3; 96/48 R; 96/50 R; 96/66 R

[51] Int. Cl.[2] ..... G03C 5/30; G03C 5/26

[58] Field of Search ..... 96/66.3, 66 R, 50 R, 48 R

[56] References Cited

UNITED STATES PATENTS

| | | | |
|---|---|---|---|
| 3,189,454 | 6/1965 | Luckey et al. | 96/95 |
| 3,567,441 | 3/1971 | Vogt | 96/66 R |
| 3,723,126 | 3/1973 | Price | 96/48 R |
| 3,746,544 | 7/1973 | Heilmann | 96/66 R |
| 3,748,138 | 7/1973 | Bissonette | 96/66 R |

*Primary Examiner*—Mary F. Kelley

*Attorney, Agent, or Firm*—Alexander, Sell, Steldt & DeLaHunt

[57] ABSTRACT

Low contrast, rapid access, air stable, regenerable iron chelate developer solutions comprising at least two developer materials, at least one selected from each group comprising:

1. iron chelate developers and
2. amidol, gallic acid, tannic acid, and 2,5,di-tert-butyl hydroquinone.

3 Claims, No Drawings

LOW CONTRAST, RAPID ACCESS, AIR STABLE, REGENERABLE IRON CHELATE DEVELOPER SOLUTIONS

This invention relates to photographic science and in particular to silver halide photographic emulsion development.

Exposure of a silver halide emulsion to radiation to which the emulsion has been sensitized produces a latent image in the silver halide grains of the emulsion. The image is latent because the grains are sensitized to reduction by the formation of minute quantities of free silver in the grains from the exposure. The grains are developed usually by immersion of the exposed photosensitive material in an aqueous reducing solution. The reducing agents conventionally employed include such organic materials as hydroquinone and other materials meeting the criteria of Kendall's Rule or the extension of this rule by Peltz [Mason, Photographic Chemistry, pp. 16–29, Focal Press, 1966, London].

Historically, the organic reducing agents presently in commercial use were preceded by the use of inorganic metal salt solutions as developers. Ferrous sulfate solutions were among the first used, these being followed by complexed ferrous ion solutions such as ferrous oxalate. Although the complexed ion solutions offered tremendous developing advantages over the simple salt solutions, they nonetheless still suffered from exhaustion because of the antagonistic effect of the presence of the oxidized form of the metal ion (e.g., ferric). Because the reduction of the silver with the consequent oxidation of the metal ion is an equilibrium reaction, the presence of ferric ions greatly reduces the thermodynamic driving force for the reaction. The improvement offered by the complexing species was in the suppression of the oxidized form of the metal ion by formation of the complex. The failure of these complexed type developers, even with the introduction of the superior complexing agents, due to oxidized ion, is generally unavoidable since these oxidized ions may be formed by development or aerial oxidation. In fact, in order to obtain consistent results with such developers, development has been performed under a nitrogen atmosphere so as to exclude oxygen (U.S. Pat. No. 2,453,323). Other techniques have been attempted to obtain consistent results in these metal salt solutions, such as the inclusion of metal powders or granules in the development solution itself, trying to maintain the dissolved metal ions in their lower valence state. Amman-Brass, Beitrag Zur Chemie dir Anorganischen Entwickler, Photo. Ind. 1937, p. 827. These developers have not found favor in the photographic field because the developing solutions are, at their best, still slow acting, requiring at least about 20 minutes for completion of development and sometimes hours. The solutions also tend to produce low contrast images and do not correct for other changes in the composition of the bath due to the development process.

Recent work has been directed towards obtaining more active rapid acting developers. S. Mizusawa - Chiba Daiga Ku Kobabubu Kentyu Hokoku (Research Reports Chiba U. Facility of Engineering), Vol. 19 No. 35 pp. 77–84, March 61 discloses a monobath developer based on the use of ferrous EDTA (ethylenediaminetetraacetic acid) and hypo (Na or $NH_4$ thiosulfate). Although Mizusawa shows the superadditivity of development by the addition of phenidone to this system he nevertheless requires a pH of 11.0 with a development time of 8 minutes or more at 20°C. to obtain average contrasts in the order of 1.0.

Vogt, U.S. Pat. No. 3,567,441 discloses that these developers are suitable for rapid access development at temperatures ranging from 65°F. to 212°F. in a pH range of 4 – 6.9 with development times in the order of 3 minutes. In order to obtain these short processing times of 3 minutes or less, this patent states that a hardening agent for the gelatin must be included in this developer. The inclusion of aldehydes in metal complex developers has previously been reported in British Pat. No. 741, 1889.

It is believed that the Vogt process must operate under a non-oxidizing atmosphere (e.g., nitrogen) in order to operate consistently. In view of this requirement the practical application of these developers has been reported (G. Haist et al., Photo. Engineering, Vol. 7, 182–189, 1956) as still limited.

It is therefore one aspect of this invention to show developer solutions which are rapid access, air stable, and low contrast developers.

In its broadest aspects therefore, this application is concerned with low contrast, air stable, rapid access developers. In a more limited aspect, the developers of this invention are developers comprising at least one metal chelate developer and at least one stabilizing developer selected from the group consisting of amidol, gallic acid, tannic acid and 2,5,di-tert-butylhydroquinone.

In the practice of this invention, the metal chelate developer and the second developer should each be present in a concentration of at least 0.05 M, up to the solubility limits of the developers.

The term metal chelate developing agent as used in the practice of this invention refers to iron associated with a chelating agent, sequestering agent or complexing agent (for the practice of this invention, these are alternative terms). The metal portion of the metal chelate is required to have at least two distinct valence states (i.e., $Fe^{+2}$ and $Fe^{+3}$ for iron).

The lower valent ion is the developing agent (reducing agent) which usually functions by simple electron transfer to the silver ion; the higher valent metal ion is formed as a result. The presence of these latter oxidized ions (higher valent ions) provides an antagonistic effect toward the further reduction of silver halide by the lower valent ion, and small buildup of such higher valent ions by either the result of development or aerial oxidation is sufficient to seriously hamper the development reaction.

The chelate portion of the metal chelate are those chelate, sequestering or complexing materials whose stability constant for the higher valence state of a metal is higher than that for the lower valence state. These stability constants may be found for example in reference books (e.g., *Stability Constants of Metal-Ion Complexes*, Chemical Society, London, 1964). In the most preferred embodiments, the ratio of the stability constants of the higher state to the lower state should be at least 100:1 respectively. The most preferred chelating agents in the practice of this invention are ethylenediaminetetraacetic acid and diethylenetriaminepentaacetic acid (EDTA and DTPA respectively).

For a particular metal ion developer, satisfactory complexing agents are those which form a more stable complex with the higher valent ion that the lower valent ion (Mason, *Photographic Chemistry*, Focal Press, 1966, p, 173) thus effectively reducing the concentration of the antagonist higher valent ion. The fact is, nevertheless, that the buildup of the higher valent ion, either by the development reaction or aerial oxidation, proceeds and even in the presence of these complexing agents, the baths eventually deteriorate and become unuseable (C. E. Mees, 2nd Ed., McMillan, 1942, p. 332). The addition of various additives such as formaldehyde (Brit. Pat. 741; 1889), though successful in hardening the emulsion, provide no improvement in aerial stability.

Rzymkowski in 194 (Rzymkowski, Wiss. Photo. 40 136 (1941)) categorized the metal complex developers as having the following structure:

$$(Alk^{+1})_n\,[(RCOO^-)_y M_m^{+z}]$$

in which Alk is an alkali metal, M is the metal ion of a multiple valent metal and R is an organic radical and y = mz + n. These materials are included within the present disclosure of metal chelates.

The earliest successful use of iron, i.e., ferrous ion, in a developer was by Carey Lea (B. J. Phot. 24, 292 (1877)). Lea utilized a "complexing agent," potassium oxalate, in his developer.

In 1951 Rausch and Russel introduced developers using a different class of complexing agents which showed much greater superiority in their affinity to complex the higher valent metal species and so exhibited some improved performance of the developers. These materials were aliphatic amino-polycarboxylic acids and their water soluble salts (Br. Pat. No. 720,235) commonly known at the times as "chelating" or "sequestering" agents which have given rise to the term "metal chelate developers." Rzymkowski in 1951 (Pharmazie (1951) 6, p. 155–6) noted that these developers fitted his definition and equated the terminology of "metal complex" and "metal chelate" developers (Industrie Chim. Belg. Spec. No. 645–6 (1955)). This terminology based on this narrowed definition for the work "complex" persists to the present, and in fact there are few metal complex developers which are based on a complexing agent rather than a chelating agent of one sort or another.

The practice of this invention generally relates to air stable, rapid access and regenerable describe substantive properties of the developer solutions.

Air stable metal chelate developer solutions are those which do not undergo a change of greater than 50 millivolts in its redox potential during two days exposure. In the use of these metal chelate developers, such air stability enables the maintenance of a desired level of developmental activity without requiring the gross addition of replacement chemistry.

The solutions of this developing system are rapid access developers. This means that the dwell time in the developer need be only 4 minutes or less for producing a useful image having 90 percent of the useful Dmax produced by that developer in 8 minutes with the same exposure and handling of the photographic element. The useful Dmax may, of course, depend upon the particular application of the photographic element, but must be viewable over fog levels of the elements. It is preferred that the dwell time need be only 2 minutes for 90 percent of the useful Dmax of 4 minutes dwell time in the same developer.

The solutions are also regenerable. This means that the solution, after or during use may be maintained at the same level of electromotive potential without the gross addition of replacement chemistry. The solutions of this invention may be maintained at the proper level of chemical activity by the reduction of the spent (oxidized) metal ions to their development (reduced) state without the addition of supplemental chemistry, i.e., by only the contacting of the spent metal ion with a metal which will reduce the ion. In addition, the term regenerable means that if the system is allowed to stand in air when not operating, the operating electrochemical potential of the solution can be reached within one hour by contacting the solution with sufficient surface area of metal capable of reducing oxidized metal developer ions.

The developer solutions according to the practice of this invention may additionally contain those additives commonly associated with developer solutions. These additives include for example, hardeners (e.g., aldehydes, aluminum salts, etc.), swell control agents (e.g., sulfate), antifoggants, development accelerators, surfactants, viscosity control agents and various pH buffering agents. The developer solutions of this invention are also easily concentrated. Concentrates of these solutions are also air stable and may be readily diluted with water to form developer solutions. Silver complexing materials (containing or not containing silver) may also be added to these developing solutions to obtain physical and/or solvent development characteristics.

The developer solutions of the present invention may be used with any black and white silver halide photographic element, and in any black and white development step for any color silver halide photographic elements.

A further understanding of the present invention may be obtained from the examples.

EXAMPLE 1

Samples of a controlled sensitometrically exposed commercial chlorobromide silver halide element were developed in a series of developer solutions having different redox potential, measured on a conventional pH millivolt meter using a platinum indicating electrode and a saturated calomel reference electrode. The samples were developed for 30 sec. at 90° F, washed, fixed, washed and dried. The developer solutions were prepared by adding sufficient solution B to solution A to yield a series of developer solutions of varying redox values. After processing these samples, resultant densities of the processed films were measured by a MACBETH densitometer at identical exposure values. Table 1 gives the results of these measurements.

| Solution A | Solution B |
|---|---|
| .1 molar $FeSO_4$ | .1 molar $Fe_2(SO_4)_3$ |
| .2 molar DTPA | .2 molar DTPA |
| .03 molar KBr | .03 molar KBr |

The pH of each solution was adjusted to 6.0 with sodium hydroxide.

TABLE I

| (MV.) | Redox | Density |
|---|---|---|
| | −184 | 1.23 |
| | −150 | 1.02 |
| | −110 | .72 |
| | −70 | .45 |

It can be seen from the Table 1 data (which is plotted in FIG. 1) that there is a direct relationship between photographic effect (density) and Redox Potential.

EXAMPLE 2

5 gm/ltr. additions of various materials were made to solution A of Example 1. The resulting solutions were stored and monitored at varous times for their redox potential using the apparatus as described in Example 1. The following table presents the list of these additions and the redox changes resultant after 1, 2 and 4 day intervals from their fresh redox values.

TABLE II

| Material | REDOX CHANGE Millivolts | | | DENSITY CHANGE |
|---|---|---|---|---|
| | Δ1 day | Δ2 day | Δ4 day | Δ4 day |
| Amidol | 0 | 0 | 0 | −.04 |
| No Addition | +90mv | +180 | +260 | −1.10 |
| Hydroquinone | +78 | +125 | +200 | −1.03 |
| Hydroxylamine Sulfate | +65 | +124 | +212 | −.97 |
| Sodium Sulfite | +50 | +100 | +225 | −1.12 |
| Ascorbic Acid | 0 | +10 | +30 | −.18 |
| Sodium Formaldehyde Sulfoxylate | +30 | +60 | +100 | −.88 |
| *Phenidone | +24 | +135 | +217 | −1.09 |
| Hydroxy quinoline | +82 | +150 | +230 | −1.06 |
| Latic Acid | +88 | +175 | +270 | −1.08 |
| Tartaric Acid | +87 | +174 | +250 | −1.03 |
| Citric Acid | +80 | +156 | +236 | −.96 |
| Toluenesulfonic Acid | +58 | +125 | +230 | −.98 |
| Gallic Acid | +05 | +26 | +40 | −.20 |
| Tannic Acid | +07 | +21 | +32 | −.17 |
| 2,5 Di-tert-butyl hydroquinone | +12 | +30 | +42 | −.22 |

*2 gm/l

It can be readily seen that amidol, gallic acid, tannic acid and 2,5, di-tert-butyl hydroquinone are effective in stabilizing the developing ability of the metal chelate developer solution. Ascorbic acid also stabilized the solution but produces too high a contrast for the practice of this invention (cf. U.S. Ser. No. 391,506).

EXAMPLE 3

Samples of a controlled sensitometrically exposed chlorobromide silver halide element was developed in a series of developer solutions, fresh and 4 days old as given in Example 2. The samples were developed for 30 sec. at 90°F, washed, fixed*, washed and dried. After processing the resultant densities of these processed films were measured with a MACBETH densitometer at identical exposure values. Table II, column 5 represents the changes in density of identical exposures between the fresh and 4 day developer samples. The relatively consistent densities produced by the developers of this invention after storage indicate the air stability of these low contrast developer solutions.

*The fixing solution in all examples was the F-5 Fixer of Eastman Kodak, the formula as referenced in Photo Lab Index, Morgan and Morgan, Inc., Hastings on Hudson, N.Y. 1966, pp 6-91.

The contrasts of the materials processed fresh from Example 3 were measured.

| Samples | Contrast |
|---|---|
| No addition | 1.4 |
| Amidol | 1.48 |
| Gallic Acid | 1.37 |
| Tannic Acid | 1.42 |
| 2,5, Di-tert-butyl hydroquinone | 1.34 |
| Ascorbic Acid | 1.75 |

It can be seen from comparing the data of Example 2 and this example that amidol, gallic acid, tannic acid, and 2,4, -di-tert-butyl hydroquinone with metal chelate developers yield low contrast, air stable, rapid access developing solutions.

Those compounds added to metal chelate developer solutions according to the practice of this invention are known in the art to have limited utility as developing agents (e.g., 2,5, di-tert butyl hydroquinone must be used at high pH). All of these compounds by themselves are not able to perform according to the practice of this invention; that is, solutions of those materials are not rapid access, air stable, regenerable developer solutions.

One ancillary aspect of the practice of this invention is the ease of disposing of many solutions used according to this invention. In particular, when using iron, these aqueous solutions generally contain materials which can easily be disposed of without great harm to the environment.

As can be readily observed, none of the developer solutions in the examples contain a fixer or silver halide solvent, and the addition of an effective amount of fixer is not part of the present invention. The developer solutions of all examples in the practice of this invention are non-fixing developer solutions.

We claim:

1. A rapid access, low contrast air stable non-fixing developer solution which comprises an iron chelate photographic developer and at least one second developer selected from the group consisting of amidol, gallic acid, tannic acid and 2,5, di-tert-butyl hydroquinone.

2. The developer solution of claim 1 wherein the iron chelate developer is selected from ferrous ethylenediaminetetraacetic acid and ferrous diethylenetriaminepentaacetic acid.

3. The developer solution of claim 1 wherein the developers are each present in a concentration of at least 0.05 M.

* * * * *